US011434903B2

(12) United States Patent
Lettini et al.

(10) Patent No.: US 11,434,903 B2
(45) Date of Patent: Sep. 6, 2022

(54) VOLUMETRIC GEAR MACHINE WITH HELICAL TEETH

(71) Applicant: CASAPPA S.P.A., Collecchio (IT)

(72) Inventors: Antonio Lettini, Parma (IT); Marco Guidetti, Parma (IT); Manuel Rigosi, Parma (IT)

(73) Assignee: CASAPPA S.P.A., Collecchio (IT)

( * ) Notice: Subject to any disclaimer, the term of this patent is extended or adjusted under 35 U.S.C. 154(b) by 0 days.

(21) Appl. No.: 17/057,427

(22) PCT Filed: May 14, 2019

(86) PCT No.: PCT/IB2019/053969
§ 371 (c)(1),
(2) Date: Nov. 20, 2020

(87) PCT Pub. No.: WO2019/229566
PCT Pub. Date: Dec. 5, 2019

(65) Prior Publication Data

US 2021/0215156 A1 Jul. 15, 2021

(30) Foreign Application Priority Data

Jun. 1, 2018 (IT) ..... 102018000005956

(51) Int. Cl.
*F04C 2/08* (2006.01)
*F04C 2/18* (2006.01)

(52) U.S. Cl.
CPC ..... *F04C 2/18* (2013.01); *F04C 2/084* (2013.01)

(58) Field of Classification Search
CPC .... F04C 2/18; F04C 2/084; F04C 2/14; F04C 18/14; F04C 18/18; F04C 2240/20; F04C 2240/60; F05B 2240/20; F05B 2240/60
See application file for complete search history.

(56) References Cited

U.S. PATENT DOCUMENTS

| | | | | |
|---|---|---|---|---|
| 3,640,650 | A | 2/1972 | Wydler | |
| 3,765,303 | A | 10/1973 | Fischer et al. | |
| 5,454,702 | A | 10/1995 | Weidhass | |
| 8,827,668 | B2 | 9/2014 | Giuseppe | |
| 9,267,594 | B2 * | 2/2016 | Benedict | F16H 55/17 |
| 9,567,999 | B2 | 2/2017 | Ferretti et al. | |
| 10,161,495 | B2 * | 12/2018 | Benedict | G05B 19/182 |
| 10,612,639 | B2 * | 4/2020 | Hesse | F16H 55/08 |

(Continued)

FOREIGN PATENT DOCUMENTS

| | | |
|---|---|---|
| CN | 101994690 A | 3/2011 |
| CN | 104379934 A | 2/2015 |

(Continued)

*Primary Examiner* — Audrey B. Walter
*Assistant Examiner* — Dapinder Singh
(74) *Attorney, Agent, or Firm* — Pearne & Gordon LLP

(57) ABSTRACT

A volumetric gear machine interacting with a working fluid comprising:

a first toothed wheel (3) with helical teeth comprising a first tooth (31) in turn comprising a first and a second flank (311, 312) opposite each other;

a second toothed wheel (4) with helical teeth having two opposite flanks, the first and the second wheel (3, 4) being operatively coupled in a meshing area (2).

At a portion of the meshing area (2), the first and the second flank (311, 312) being in simultaneous contact with the second wheel (4).

8 Claims, 4 Drawing Sheets

(56) References Cited

U.S. PATENT DOCUMENTS

| | | | | |
|---|---|---|---|---|
| 2002/0134184 | A1* | 9/2002 | Hawkins | F16H 55/08<br>74/457 |
| 2010/0158739 | A1 | 6/2010 | Ni et al. | |
| 2011/0033330 | A1 | 2/2011 | Endres et al. | |
| 2011/0223051 | A1 | 9/2011 | Giuseppe | |
| 2016/0265528 | A1 | 9/2016 | Ferretti et al. | |

FOREIGN PATENT DOCUMENTS

| | | | |
|---|---|---|---|
| CN | 104389640 | A | 3/2015 |
| DE | 2421891 | A1 | 11/1975 |
| DE | 4138913 | C1 | 6/1993 |
| JP | H112191 | A | 1/1999 |
| KR | 20030080609 | A | 10/2003 |
| TW | 201619503 | A | 6/2016 |
| WO | 9601950 | | 1/1996 |
| WO | 9601950 | A1 | 1/1996 |
| WO | 2010063705 | A1 | 6/2010 |
| WO | 2017088980 | A1 | 6/2017 |

* cited by examiner

VOLUMETRIC GEAR MACHINE WITH HELICAL TEETH

TECHNICAL FIELD

The present invention relates to a volumetric gear machine, typically a pump or an engine.

PRIOR ART

Pumps are well-known comprising a first and a second toothed wheel with helical teeth that mesh each other so as to make the mechanical contact of the gears more gradual. They are interposed between a suction and a delivery conveying a working fluid from the former to the latter.

A drawback of this type of pumps is connected with the fact that special attention must be paid to the hydraulic seal between the helical teeth. In fact, to prevent the delivery and suction becoming directly connected for a certain angular operating range, the helical extension of the tooth must be carefully studied and constraints must be complied with which drastically reduce the designer's freedom. Known solutions prevent hydraulic seal problems by using teeth that extend according to not very accentuated helices. It would be useful to be able to have high helices so as to have more gradual contact, lower contact pressure between the teeth and a more gradual variation of the transferred fluid volumes.

Pumps with gears that have straight teeth (therefore not helical) with double contact (the teeth that mesh come into contact in two distinct zones on opposite sides) are also known. In pumps with straight teeth, double contact cannot be used to improve the hydraulic seal for the reasons set out below. In pumps with straight teeth and single contact, in order to guarantee the hydraulic seal, the condition $\varepsilon TR \geq 1$ must be satisfied ($\varepsilon TR$ indicating the transverse contact ratio defined as the ratio between the rotation of the wheel so that a tooth thereof can travel along the entire action line and the angular step; action line means the segment in which the toothed wheels come into contact during operation).

Double contact envisages two lines of action and would theoretically allow the hydraulic seal if the relationship $\varepsilon TR \geq 0.5$ is satisfied (and not $\varepsilon TR \geq 1$ as in the case of single contact teeth) hence leaving greater freedom in the shape of the tooth with respect to a pump with straight teeth and single contact. But, in fact, such freedom cannot be used as another essential condition for these types of pumps would be compromised and that is the continuous transmission of the motion of the driving wheel to the contact wheel; in the case of pumps with straight tooth gears such a condition translates into respect for the following mathematical condition: $\varepsilon TR \geq 1$ Respect for such relationship therefore thwarts the advantages that double contact could offer for the hydraulic seal.

Pumps, as disclosed in US2011/223051 and WO96/01950, are known.

OBJECT OF THE INVENTION

The object of the present invention is to propose a gear machine that overcomes the above-illustrated drawbacks connected with the mechanical and hydraulic optimisation of the gears, in particular of the tooth helix.

The stated technical task and specified objects are substantially achieved by a gear machine comprising the technical features disclosed in one or more of the appended claims.

BRIEF DESCRIPTION OF THE DRAWINGS

Further characteristics and advantages of the present invention will become more apparent from the following indicative and therefore non-limiting description of a gear machine as illustrated in the appended drawings, in which.

DETAILED DESCRIPTION OF PREFERRED EMBODIMENTS OF THE INVENTION

Figure 1:
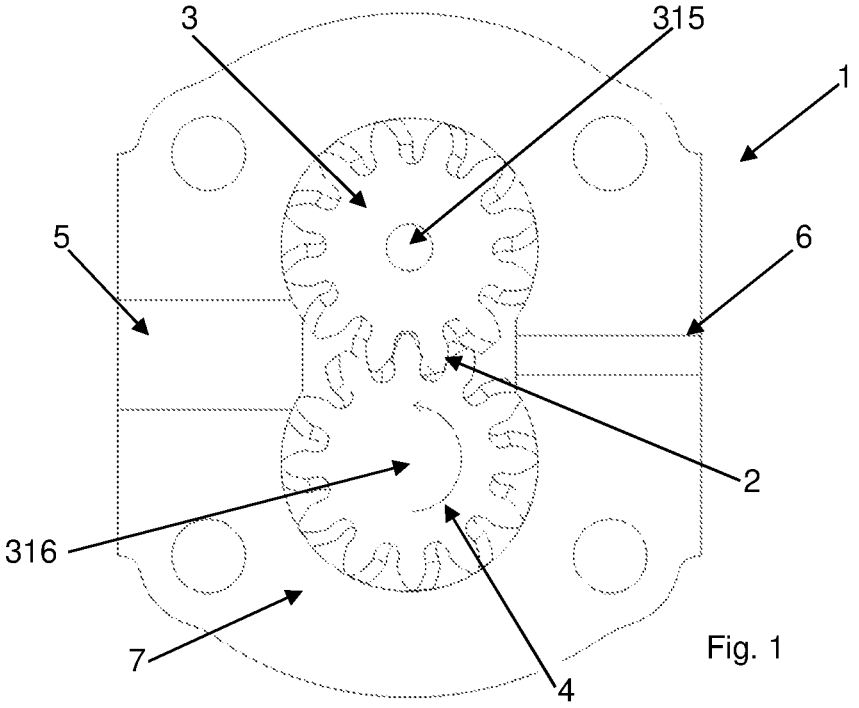
FIG. 1 is a sectional view of a gear pump according to the present invention.

In the accompanying figures reference number 1 denotes a volumetric gear machine. Such machine 1 is a pump or an engine. The machine 1 is intended to convey a working fluid (typically incompressible, preferably oil).

The machine 1 comprises a working fluid inlet and a working fluid outlet. In the case of a pump the inlet is usually called suction whereas the outlet is called delivery. In the case of an engine the inlet is called induction and the outlet is called exhaust.

The machine 1 comprises a first toothed wheel 3 with helical teeth. Appropriately all the teeth of the first wheel 3 are the same as each other.

The helical teeth of the first wheel 3 comprise a first tooth 31 which in turn comprises a first and a second flank 311, 312 opposite each other. The first and second flank 311, 312 contribute to defining two compartments intended to convey the working fluid. Appropriately at least one section of the first and second flank 311, 312 are involutes of a circle.

The portion of the first flank 311 that extends as an involute of a circle affects advantageously more than ⅓, preferably at least ½, of the height of the first tooth 31. The height of the tooth means the difference between the tip radius and the root radius.

The description with reference to the first tooth 31 may also be repeated for the other teeth of the first wheel 3.

The machine 1 comprises a second toothed wheel 4 with helical teeth. The helical teeth of the second toothed wheel 4 appropriately comprise an involute profile. Also in that case the teeth of the second wheel 4 have two opposite flanks at least one portion of which has an involute shape (the involute portion advantageously affects at least ⅓, preferably at least ½ of the height of the tooth). Appropriately, the teeth of the first and second wheel 3, 4 are the same as each other. As exemplified in the figures, the machine 1 advantageously has external gears (the first wheel 3 and the second wheel 4 are therefore flanked externally to each other). In an alternative solution one of the two gears could be at least partially internal to the other.

The use of an involute profile allows friction, vibrations, noise and wear to be minimised. In line with common practice in the technical sector, involute profile also means profiles that have a correction of a few tenths of a millimetre with respect to the theoretical involute line (in the case in question the displacement is less than 5% of the normal module of the tooth). It is underlined that in the technical sector the normal module of a tooth is defined as: $d/Z \cdot \cos \beta$ wherein:

d: primitive diameter;

Z: number of teeth;

β: angle of the helix at the primitive diameter.

The first tooth 31 periodically comes into contact with the second wheel 4 only at the first and second flank 311, 312.

The helical teeth of the first wheel 3 and of the second wheel 4 are truncated at the tip. The tip of the teeth is therefore substantially flat.

Figure 2:
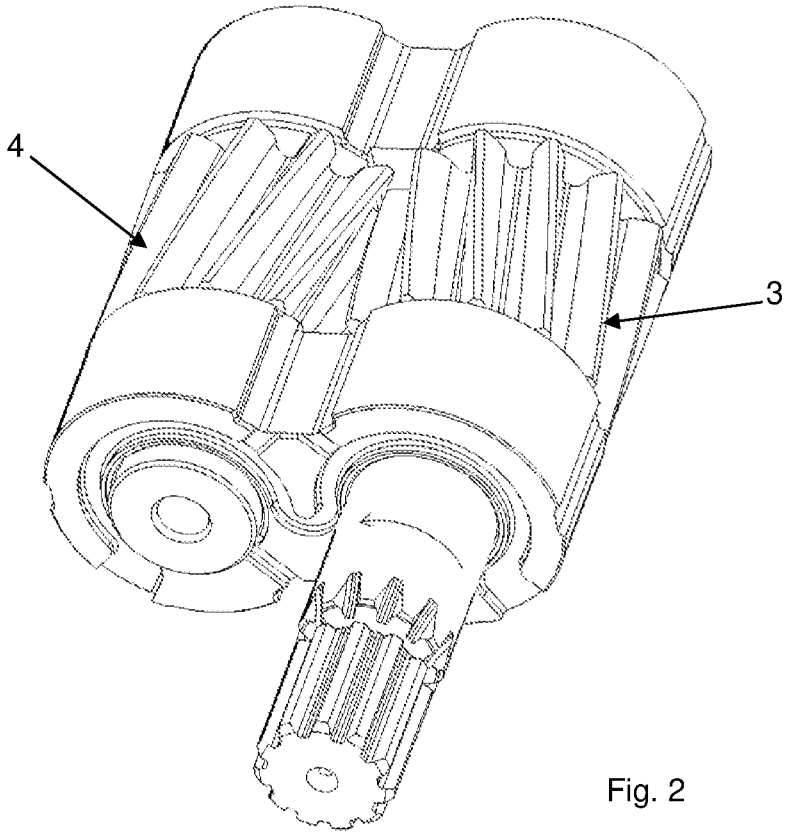
FIG. 2 shows a perspective view of revolving bodies of a pump according to the present invention.

As exemplified in FIG. 2, the first and/or the second wheel 3, 4 are cylindrical toothed wheels. The first and second wheel 3, 4 have parallel rotation axes. Preferably, the first and second wheel 3, 4 are counter-rotating.

The machine 1 comprises a casing 7 that houses the first and the second wheel 3, 4. Appropriately the inlet 5 and the outlet 6 are afforded in said casing 7.

The first and the second wheel 3, 4 are interposed between the inlet 5 and the outlet 6.

The first and the second wheels 3, 4 are operatively coupled at a meshing area 2. The meshing area 2 is interposed between the outlet 6 and the inlet 5 of the working fluid. In particular the meshing area 2 is located along an imaginary band that connects the inlet 5 and the outlet 6 of the working fluid.

At a portion of the meshing area 2, the first and the second flank 311, 312 are in simultaneous contact with the second wheel 4. This allows an inherent hydraulic property of the double contact to be exploited which is not possible on straight teeth. In fact, an important intuition of the Applicant derives from the following theoretical analysis. For double contact helical teeth the hydraulic seal can be guaranteed by the condition $\varepsilon TR-\varepsilon EL \geq 0.5$; the case of symmetrical teeth has been considered for simplicity purposes but similar considerations can be repeated in the case of non-symmetrical teeth. In fact, in that case, both lines of contact (lines of action) cooperate for the seal. εTR means the transverse contact ratio i.e. the minimum value between $\varepsilon TR_{sx}$ and $\varepsilon TR_{dx}$ (that coincide in the case of symmetrical teeth i.e. wherein the first and the second flank 311, 312 are identical along each contact section orthogonally to the rotation axis of the first wheel 3).

$\varepsilon TR_{sx}$ means the ratio between:

the rotation of the first wheel 3 necessary so that the point of contact between the first tooth 31 and the second wheel 4 travels the entire line of action C of the first flank 311 and the angular pitch.

$\varepsilon TR_{dx}$ means the ratio between:

the rotation of the first wheel 3 necessary so that the point of contact between the first tooth 31 and the second wheel travels the entire line of action (D) of the second flank 312 and the angular pitch.

The line of action of the first flank 311 is the line drawn by the points of contact of the first flank 311 with the second wheel 4; the line of action of the second flank 312 is the line drawn by the points of contact of the second flank 312 with the second wheel 4. Appropriately, the first and/or the second line of action are rectilinear segments.

εEL indicates the helical contact ratio defined as the ratio between the phase shift of the helix and the angular pitch. The phase shift of the helix corresponds to the angular displacement between the first and the last section of the toothed wheel (evaluated orthogonally to the rotation axis) and is in turn defined as:

$$S=360\cdot L/(2\pi\cdot r_b/\tan(\beta_b))$$

where:

L: longitudinal length of the tooth;

$r_b$: base radius (at the base of the involute);

$\beta_b$: helix angle at the base diameter (at the base of the involute).

Angular pitch means the ratio between 360° and the number of teeth.

In the case of single contact helical teeth, to guarantee the hydraulic seal the relationship would be much more disadvantageous: $\varepsilon TR-\varepsilon EL \geq 1$.

Therefore, a εEL value equal to about 0 should be adopted in order to have a εTR value equal to 1. There would therefore be a good hydraulic seal, but the helix would not be thrust much and the performance would be low.

With double contact for obtaining similar results in terms of hydraulic seal, a εTR value equal to 1 can be adopted and εEL values equal to about 0.5 can be used, which allow a high helix angle and tooth sizing without too many restrictions in order to maintain the hydraulic seal. In the case of double contact helical teeth, to have a high helix it is therefore advisable to comply with the following condition: $\varepsilon TR-\varepsilon EL \leq 1$.

Figure 3A:
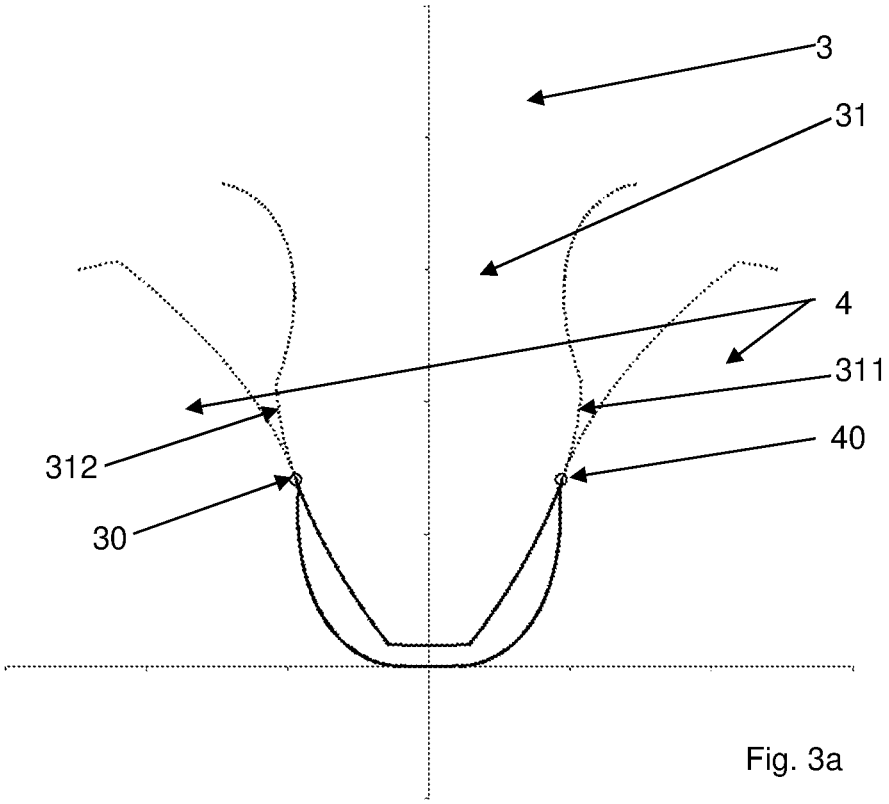
FIGS. 3*a*, 3*b*, 3*c* show cross sections along the longitudinal extension of a helical tooth of a pump according to the present invention.
Figure 3B:
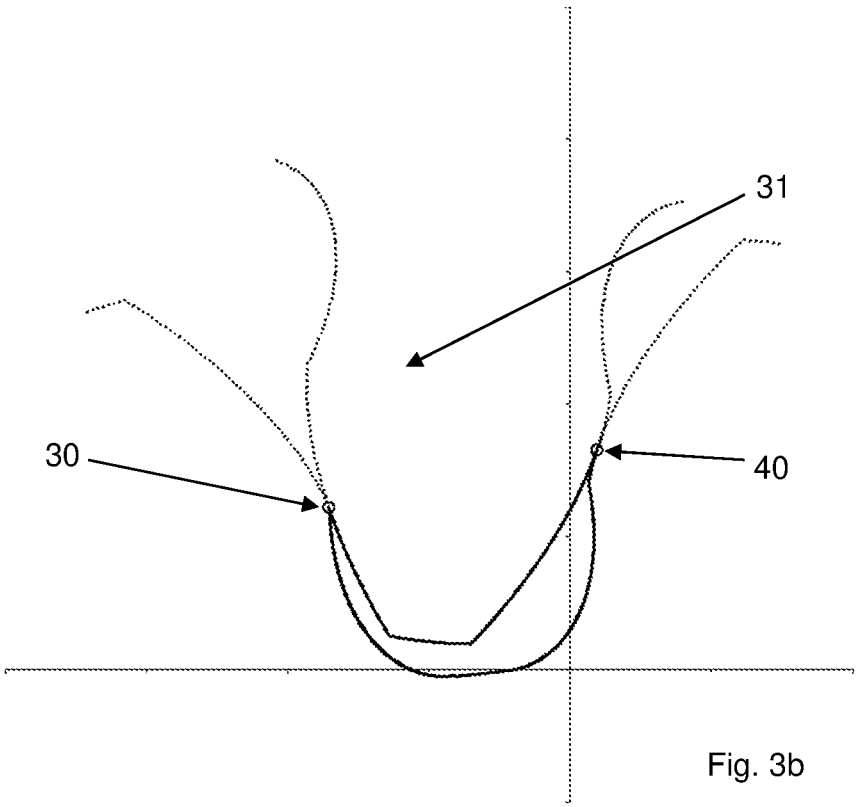
Figure 3C:
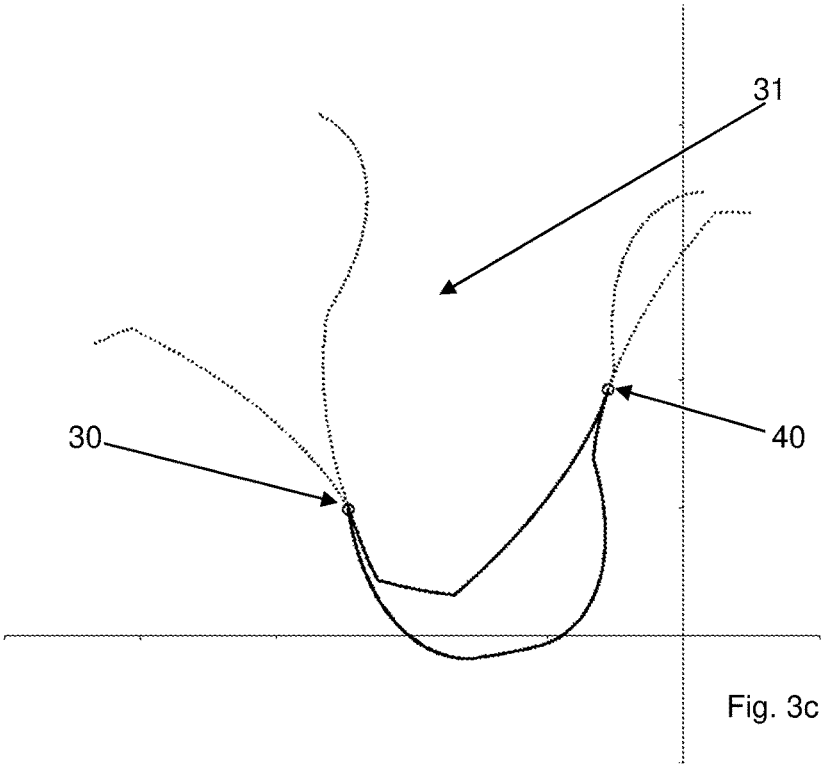

In fact, with a higher helix angle it is possible to obtain more gradual contact, lower contact pressure between the teeth and a more gradual variation of the transferred fluid volumes. FIGS. 3*a*, 3*b* and 3*c* indicate with references 30 and 40 the points of contact between the first tooth 31 and the second wheel 4. The three FIGS. 3*a*, 3*b*, 3*c* refer to a same angular position of the first and the second toothed wheel 3, 4 but refer to different cross sections of the first helical tooth 31. FIG. 3*a* relates to a cross section placed half way along the longitudinal length of the first tooth 31, FIG. 3*b* at 25% or 75% of the longitudinal length of the first tooth 31 (according to whether the helix of the tooth 31 is right- or left-handed), FIG. 3*c* is taken at one of the two longitudinal ends of the first tooth 31 (according to whether the helix is right- or left-handed). Longitudinal extension of the first tooth 31 means the extension line of the tooth that connects the two opposite shims of the pump 1. In fact, the first and the second wheel 3, 4 are axially interposed between the two shims.

Figure 4:
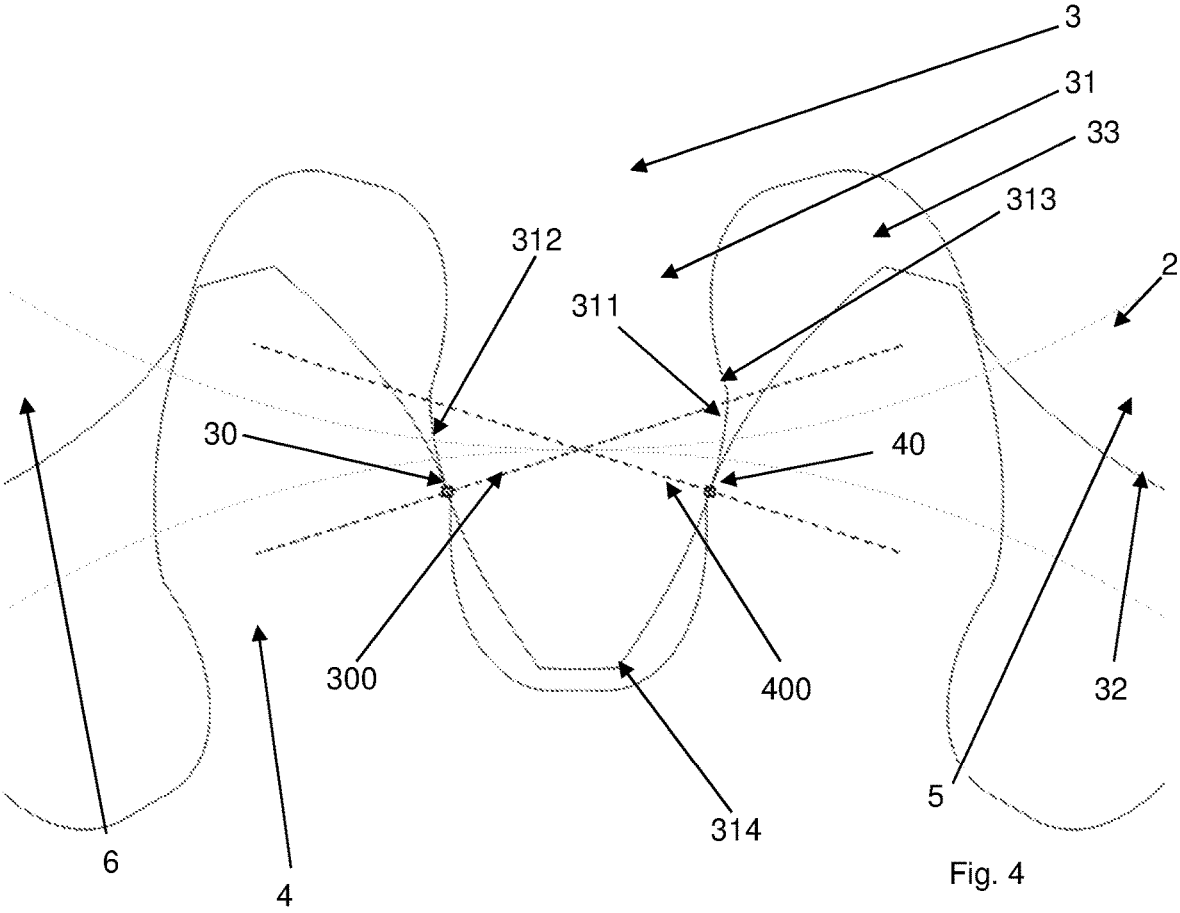
FIGS. 4 and 5 show a cross sectional view of a detail of a gear pump according to the present invention.
Figure 5:
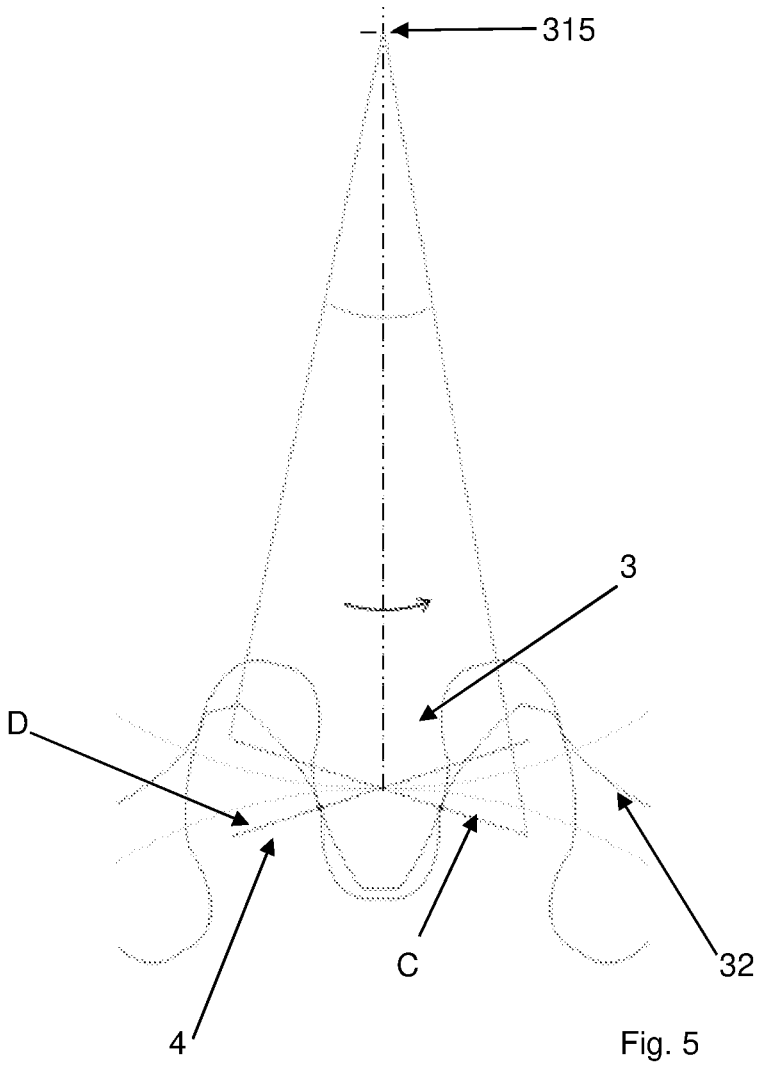

In FIG. 4, the references 30 and 40 indicate again the points of contact of the first tooth 31 with the second wheel 4. Furthermore, a first and a second line of action are shown in broken lines and indicated by references 300 and 400. They highlight the movement of the points of contact between the first tooth 31 and the second wheel 4 during the rotation of the wheels.

As mentioned previously, preferably but not necessarily, the first and the second flank 311, 312 are symmetrical.

The teeth of the first toothed wheel 3 mesh in double contact with the teeth of the second wheel 4.

In the preferred solution the first and/or the second toothed wheel 3, 4 have/has a number of teeth comprised between 8 and 14, preferably between 9 and 12 teeth. Advantageously, the helix angle at the primitive diameter of the teeth of the first and/or of the second toothed wheel 3, 4 is comprised between 8° and 20°, preferably between 12° and 16°. It indicates the angle between the extension direction of the helix and the direction identified by the rotation axis of the first and of the second wheel 3, 4. Appropriately, the angular phase shift of the helix (previously identified by the letter S) between the cross sections of opposite ends of the teeth of the first and/or of the second wheel 3, 4 is comprised between 10° and 45°, preferably between 20° and 35°.

The involute portion of the first flank 311 extends between a first and a second edge 313, 314. The first edge 313 is radially closer to a rotation axis 315 of the first toothed wheel 3 with respect to the second edge 314; the helical teeth of the first wheel 3 comprise a second tooth 32 consecutive to the first one and facing the first flank 311; a first compartment 33 being afforded as the space interposed between the first tooth 31 and the second tooth 32.

In a theoretically optimal solution the meshing of the first and of the second wheel 3, 4 has a constant hydraulic seal between the inlet 5 and the outlet 6. This means that there is always (i.e. for every angular position of the teeth) at least one pair of teeth of the first and of the second wheel 3, 4 that are in contact along their entire length. This prevents a direct connection between the inlet 5 and the outlet 6, minimising working fluid leakage and therefore optimising the volumetric performance.

However, this condition limits the designer's choice of the size of the first and the second toothed wheel 3, 4 (in particular in the generation of the cross section of the tooth and in the angular definition β of the helix). In actual fact, through experimental tests the Applicant has verified that excellent results can still be obtained in the absence of a perfect constant hydraulic seal.

In that case, a profile (typically involute) of a tooth of the first wheel 3 and the profile (typically involute) of a tooth of the second wheel 4, for at least one portion of the longitudinal length of the tooth, are no longer in contact and allow a hydraulic connection between the inlet 5 and the outlet 6.

However, it is important to contain the extension of such hydraulic connection in order to prevent excessive leakages.

When the relationship $0.5 \leq \varepsilon TR - \varepsilon EL$ 1 is satisfied there is a constant hydraulic seal and therefore the optimal solution is obtained. However, the user could be pushed to size the teeth without satisfying the relationship $0.5 \leq \varepsilon TR - \varepsilon EL$, but keeping leakages contained.

In order for the leakages not to be excessive the following condition must be respected in any case: in a configuration in which the volume of the first compartment 33 occupied by the second wheel 4 is maximum, no point of the first edge 313 is located at a radial distance from a rotation axis 316 of the second wheel 4 which is greater with respect to a tip radius of the second wheel 4.

Should a hydraulic connection be accepted between delivery and suction the involute profile of a tooth of the first wheel 3 and the involute profile of a tooth of the second wheel 4 advantageously satisfy the following characteristics (in the configuration in which the volume of the first compartment 33 occupied by the second wheel 4 is maximum):

- they are opposite each other;
- they have a minimum distance which is less than 1 tenth of a millimetre.

Furthermore, with sizing of $\varepsilon TR - \varepsilon EL \leq 0.5$ a similar effect to the one exercised by noise control exhausts placed on the shims is obtained. Noise control exhausts normally place in communication a volume of fluid that is located in a compartment in the meshing area with the high pressure environment and/or the low pressure environment. In this way, it is possible to compensate for violent pressure variations that could be generated in an isolated compartment in the meshing area (and that could determine significant strain, cavitation, noise, localised erosion). If $\varepsilon TR - \varepsilon EL \leq 0.5$ there will not be a perfect seal and this will facilitate the work of noise control exhausts. In this way, noise control exhausts can be realised on the shims with less narrow dimensional tolerances.

Appropriately the relationship $\varepsilon TOT = \varepsilon TR + \varepsilon EL \geq 1$ must be satisfied (to guarantee the continuous transmission of motion).

Hypothesizing operation as a pump, the working fluid at the inlet that is sucked by the first and by the second wheel 3, 4 is positioned in the spaces between two consecutive teeth and is substantially conveyed along two alternative paths until the outlet (which is at a higher pressure than the suction-inlet). The fluid in the passage from the inlet 5 to the outlet 6 therefore follows the rotation sense of the first and of the second wheel 3, 4.

Exemplified, but non-limiting, solutions of a pump according to the present invention developed by the Applicant are summarised by the parameters indicated in the following table (the definition of such parameters has already been indicated previously or is well known to a person skilled in the art who is familiar with the main nomenclature of toothed wheels):

| | | Ex 1 | Ex 2 |
|---|---|---|---|
| Number of teeth | Z | 12 | 11 |
| Normal module | mN [mm] | 2.6 | 2.85 |
| Normal pressure angle | αN [deg] | 20 | 20 |
| Profile displacement factor | γ [mm] | 0 | 0.25 |
| Primitive diameter helix angle | β [deg] | 16.0 | 12.0 |
| Tip radius | rA [mm] | 19.4 | 19.5 |
| Root radius | rP [mm] | 12.5 | 12.5 |
| Forming tool radius | $\rho_{A0}$ [mm] | 0.9 | 0.9 |
| Beam length | Lf [mm] | 30 | 26.5 |
| Helix displacement | S[deg] | 30.37 | 20.14 |
| Centre-to-centre distance at zero clearance | IntCORR [mm] | 32.46 | 32.53 |
| Transverse contact ratio | εTR [ ] | 1.10 | 1.16 |
| Helical contact ratio | εEL [ ] | 1.01 | 0.61 |
| Total contact ratio | εTOT [ ] | 2.11 | 1.77 |
| εTR − εEL | | 0.09 | 0.55 |
| Continuous motion transmission | | yes | yes |
| Continuous hydraulic seal | | no | yes |

The present invention achieves important advantages.

The introduction of a helix on involute profiles on one hand improves the transmission of motion and on the other worsens the hydraulic seal along the toothed band. The analysis performed by the Applicant highlighted that the combination of the helical geometry with double contact operation leads to interesting potential. In fact, the Applicant theoretically demonstrated (and the experimental data confirm this) that combining helical teeth with double contact operation allows an intrinsic hydraulic property of double contact to be exploited that is not possible on straight teeth.

The invention as it is conceived is susceptible to numerous modifications and variations, all falling within the scope of the inventive concept characterising it. Furthermore, all the details can be replaced with other technically-equivalent elements. In practice, all the materials used, as well as the dimensions, can be any according to requirements.

The invention claimed is:

1. A volumetric gear machine interacting with a working fluid comprising:

- a first toothed wheel (3) with helical teeth comprising a first tooth (31) in turn comprising a first and a second flank (311, 312) opposite to each other;
- a second toothed wheel (4) with helical teeth having two opposite flanks, the first and the second wheel (3, 4) operatively connected in a meshing area (2); the helical teeth of the first wheel (3) and second wheel (4) being truncated at a tip;

the first tooth (31) periodically comes into contact with the second wheel (4) only at the first and second flank (311, 312);

at a portion of the meshing area (2), the first and the second flank (311, 312) being in simultaneous contact with the second wheel (4);

characterised in that $0 \leq \varepsilon TR - \varepsilon EL \leq 1$ wherein:

εTR: transverse contact ratio: minimum value between εTRsx and εTRdx;

εTRsx: ratio between a rotation of the first wheel (3) necessary so that a point of contact between the first tooth (31) and the second wheel (4) travels an entire line of action (C) of the first flank (311) and an angular pitch;

εTRdx: ratio between the rotation of the first wheel (3) necessary so that the point of contact between the first tooth (31) and the second wheel (4) travels an entire line of action (D) of the second flank (312) and an angular pitch;

εEL: helix contact ratio defined as a phase shift of the helix with respect to the angular pitch, the phase shift of the helix being equal to:

$$S = 360 \cdot L / (2\pi \cdot rb / \tan(\beta b))$$

where:

S: phase shift of the helix;

L: longitudinal length of the tooth;

rb: base radius, assessed at the base of an involute;

βb: helix angle at a base radius.

2. The machine according to claim 1, characterised in that the phase shift of the helix is greater than half of the angular pitch.

3. The machine according to claim 1, characterised in that:

$$0.5 \leq \varepsilon TR - \varepsilon EL \leq 1.$$

4. The machine according to claim 1, characterised in that $$0 \leq \varepsilon TR - \varepsilon EL \leq 0.5.$$

5. The machine according to claim 1, characterised in that it is a gear pump, all the teeth of the first toothed wheel (3) meshing in double contact with the teeth of the second wheel (4).

6. The machine according to claim 1, characterised in that at least one portion of the first and second flank (311, 312) being involutes of a circle; at least one portion of the flanks of the helical teeth of the second toothed wheel (4) being involutes of a circle.

7. The machine according to claim 6, characterised in that said involute portion of the first flank (311) extends between a first and a second edge (313, 314), the first edge (313) being radially close to a rotation axis (315) of the first toothed wheel (3) with respect to the second edge (314); the helical teeth of the first wheel comprising a second tooth (32) consecutive to the first one and facing the first flank (311); a first compartment (33) being afforded as the space interposed between the first tooth (31) and the second tooth (32); in a configuration in which the volume of the first compartment (33) occupied by the second wheel (4) is maximum, no point of the first edge (313) is located at a radial distance from a rotation axis (316) of the second wheel (4) which is greater with respect to a tip radius of the second wheel (4).

8. The machine according to claim 1, characterised in that the portion of the first flank (311) that extends as an involute of a circle affects more than ⅓ of the height of the first tooth (31).

* * * * *